US005695914A

United States Patent [19]

Simon et al.

[11] Patent Number: 5,695,914

[45] Date of Patent: Dec. 9, 1997

[54] PROCESS OF FORMING A DYE IMAGE

[75] Inventors: Richard Alan Simon; James Edward Sutton; James Thomas Kofron, all of Rochester, N.Y.

[73] Assignee: Eastman Kodak Company, Rochester, N.Y.

[21] Appl. No.: 631,508

[22] Filed: Apr. 12, 1996

Related U.S. Application Data

[60] Provisional application No. 60/003,830, Sep. 15, 1995.

[51] Int. Cl. [6] ..... G03C 7/407; G03C 7/30; G03C 7/18

[52] U.S. Cl. ..... 430/379; 430/361; 430/375; 430/365; 430/380

[58] Field of Search ..... 430/361, 375, 430/379, 365, 380

[56] References Cited

U.S. PATENT DOCUMENTS

| | | | |
|---|---|---|---|
| 2,518,739 | 8/1950 | Young | 430/360 |
| 2,633,422 | 3/1953 | Jennings | 430/361 |
| 3,300,305 | 1/1967 | Pesch et al. | 96/22 |
| 3,443,942 | 5/1969 | Puschel et al. | 96/20 |
| 3,467,520 | 9/1969 | Puschel et al. | 96/53 |
| 3,615,498 | 10/1971 | Arai et al. | 96/55 |
| 3,617,273 | 11/1971 | Arai et al. | 96/22 |
| 3,647,452 | 3/1972 | Hendess et al. | 96/55 |
| 3,718,464 | 2/1973 | Janssen et al. | 96/29 |
| 3,796,574 | 3/1974 | Figueras | 430/361 |
| 4,089,685 | 5/1978 | Bissonette | 96/22 |
| 4,258,117 | 3/1981 | Morgan et al. | 430/214 |
| 4,276,372 | 6/1981 | Wernicke et al. | 430/505 |
| 4,315,069 | 2/1982 | Scott | 430/365 |
| 4,423,126 | 12/1983 | Klijanowicz et al. | 430/9 |
| 4,465,762 | 8/1984 | Ishikawa et al. | 430/376 |
| 4,912,025 | 3/1990 | Platt et al. | 430/544 |
| 4,977,521 | 12/1990 | Kaplan | 364/525 |
| 5,070,003 | 12/1991 | Naruse et al. | 430/389 |

FOREIGN PATENT DOCUMENTS

| | | | |
|---|---|---|---|
| 0 364 845 A2 | 4/1990 | European Pat. Off. | G03C 5/50 |

OTHER PUBLICATIONS

Bird, "Normal Development, Reversal Development, and Composite Processing: A New Method for Gaining a Simultaneous Improvement in Latitude etc", Nov./Dec. '78 vol. 22, No. 6, pp. 328–335.

*Primary Examiner*—Richard L. Schilling
*Attorney, Agent, or Firm*—Arthur H. Rosenstein

[57] ABSTRACT

A method of producing a dye image by processing an imagewise exposed color photographic element containing at least one silver halide emulsion layer, the emulsion layer being comprised of both latent image and non-latent image containing silver halide grains, and having a distribution of Compound X, Compound X being either a ballasted coupler capable of reacting with an oxidized developing agent of a developing solution, or a ballasted developing agent capable, in an oxidized state, of reacting with a component of a developing solution, said method comprising:

A. contacting the photographic element with a first developing solution to develop the latent image containing grains and to imagewise convert the distribution of Compound X to a first dye;

B. rendering the non-latent image containing grains developable; and

C. contacting the photographic element with a second developing solution to develop the non-latent image containing grains, and to convert residual Compound X to a second dye;

wherein the first dye has a spectral characteristic which is non-coextensive with that of the second dye.

16 Claims, No Drawings

PROCESS OF FORMING A DYE IMAGE

CROSS REFERENCE TO RELATED APPLICATION

Reference is made to and priority claimed from U.S. Provisional Application Ser. No. 60/003,830, filed 15 Sep. 1995, entitled PROCESS OF FORMING A DYE IMAGE.

FIELD OF THE INVENTION

The invention relates to a method of producing a photographic image. In particular, it relates to a method of producing a dye image in an imagewise exposed photographic element by combining the information recorded in the element's latent image and non-latent image containing silver halide grains.

BACKGROUND OF THE INVENTION

Photography is the science of capturing an image on a tangible medium by exposure of a light sensitive material to actinic radiation and subsequent processing of the material to produce a visible image. Typically, silver halide grains are utilized as the light sensitive component of the light sensitive material. Upon exposure, they form what is known in the art as a latent image, which is the invisible precursor of the useful visible image that appears during photographic processing. The latent image, and more specifically the metallic silver which comprises the latent image, serves to catalyze the reduction of silver ions to silver metal during processing, thus forming the visible image in black and white photographic materials, and forming dye precursors to the visible image in color negative or color reversal photographic materials.

Latent images are, as described, a physical record of the exposure of a photographic element. They are, however, not the complete record, as silver halide grains which do not form a latent image during exposure contain an additional amount of information regarding the exposure, albeit in the form of a mirror image. To obtain the best possible reproduction of an image—that is, a reproduction embodying the complete record of exposure—it would therefore be desirable to combine the information recorded in both a photographic element's latent image containing and non-latent image containing silver halide grains. This is especially true in certain types of photographic applications, for instance professional, scientific, and industrial applications, which require higher integrity in the reproduction of images.

Though limited in scope, work has been performed in the area of combining the various forms of information recorded in an exposed photographic element. In Bird, "Normal Development, Reversal Development, and Composite Processing: A New Method for Gaining a Simultaneous Improvement in Latitude and Detective Quantum Efficiency in Silver Halide Films", *Photographic Science and Engineering*, Vol. 22, No. 6, pages 328–335, November/December, 1978, a digital image processing algorithm is proposed for combining the information recorded in both the negative (latent image) and positive (non-latent image) scales of a photographic element to maximize the element's detective quantum efficiency (DQE). Detective quantum efficiency, in short, is an indication of the imaging efficiency (i.e., the square of the signal to noise ratio of the developed film image relative to the square of the signal to noise ratio of the image being recorded) of a photographic element. This metric of imaging efficiency is described in considerable detail in *The Theory of the Photographic Process*, Fourth ed., edited by T. H. James, pages 636–643.

Although Bird teaches that it is desirable in certain instances to combine the information recorded in both the negative and positive scales of an exposed element, he proposes that the way to accomplish this is by subjecting the element to (a) a first processing step wherein both a coupler and a developing agent are added to the element to interact with the latent image forming grains, thus forming a dye image; (b) a fogging exposure; and (c) a second processing step wherein a developing agent and a second coupler are added to the element to interact with the fogged grains, thus forming a second dye. Bird therefore proposes to imagewise add to the element a dye corresponding to the latent image, and then to follow this up by adding a second dye corresponding to the non-latent image forming grains.

In conventional multicolor photographic elements employing three or more image recording units, with each unit producing to a yellow, cyan, or magenta color record, Bird's method, which is based upon a variant of the Kodachrome™ (Eastman Kodak Company) processing scheme, would be incapable of forming two different useful dye images in each of the image recording units.

In Kaplan, U.S. Pat. No. 4,977,521, an improvement over Bird is sought. Bird is alleged to be based upon, at the very least, inappropriate assumptions relating to film characteristics. Kaplan proposes an improved digital image processing algorithm based upon Bayes theorem that optimally combines the image information in the positive and negative scales so as to minimize the granularity of the combined image. Kaplan, however, suffers from the same deficiency inherent in Bird, namely that it does not provide a methodology by which one could form two different useful dye images in each of the image recording units of a multicolor image recording system. Furthermore, both Kaplan and Bird are inadequate for current industry needs which require easier methods of achieving improvements in image quality and imaging efficiency.

Problem Solved by the Invention

The art has failed to provide an efficient method of processing an exposed photographic element that results in adequate image quality and imaging efficiency. Further, the art has failed to provide a means by which to obtain, in a useful form, the information recorded in both the latent image and non-latent image containing grains of an exposed multicolor photographic element employing multiple image recording units.

SUMMARY OF THE INVENTION

It is thus an object of the present invention to provide a method of processing a photographic element which overcomes the imaging efficiency and image quality deficiencies of the art, and which can be practiced with multicolor photographic elements employing multiple image recording units.

This and other objects of the invention, which will become apparent below, are achieved by a method of producing a dye image by processing an imagewise exposed color photographic element containing at least one silver halide emulsion layer, the emulsion layer being comprised of both latent image and non-latent image containing silver halide grains, and having a distribution of Compound X, Compound X being either a ballasted coupler capable of reacting with an oxidized developing agent of a developing solution, or a ballasted developing agent capable, in an oxidized state, of reacting with a component of a developing solution, said method comprising:

A. contacting the photographic element with a first developing solution to develop the latent image containing grains and to imagewise convert the distribution of Compound X to a first dye;

B. rendering the non-latent image containing grains developable; and

C. contacting the photographic element with a second developing solution to develop the non-latent image containing grains, and to convert residual Compound X to a second dye;

wherein the first dye has a spectral characteristic which is non-coextensive with that of the second dye; and wherein, preferably, the emulsion layer also contains a stoichiometric excess of silver.

The present invention is an improvement over the art in that it provides a means by which to obtain improved image quality and imaging efficiency in multicolor photographic elements employing multiple image recording units. It also provides a means by which to more easily obtain the image quality and imaging efficiency improvements previously realized in the art by both Bird and Kaplan.

DETAILED DESCRIPTION OF THE INVENTION

A. Definitions:

The present invention relates to a method of producing a dye image by application of certain processing steps to an imagewise exposed photographic element. Practice of the method involves an imagewise conversion of Compound X to a first dye upon exposure of Compound X to latent image containing grains and the first developing solution. By "imagewise", it is meant that the distribution of Compound X is directly affected by the presence or lack of latent image containing grains. Where such grains are present, thus indicating a region in the emulsion of relatively high exposure, Compound X will be converted upon contact with the first developing solution. Where there are no such grains, the distribution of Compound X will be unaffected until contact of the emulsion with the second developing solution, where some of it will be converted to a second dye by development of the non-latent image containing grains. Conversion of Compound X to a first dye results in the imprinting of the latent image in the underlying distribution of Compound X, and results in improved image quality and imaging efficiency when the residual (i.e., that which was not converted to a first dye) Compound X is converted to a second dye upon contact with the second developing solution.

The first and second dyes produced by practice of the present invention preferably have peak absorptions falling in the spectral region greater than or equal to 400 nm. Further, they have spectral characteristics that are non-coextensive. By "non-coextensive", it is meant that the spectral region in which the first dye absorbs light is distinguishable using scanning and digital processing techniques from the spectral region in which the second dye absorbs light. Preferably, the dyes have half-peak absorption bandwidths which are offset by no less than 50%. This means that upon completion of photographic processing, each dye has a half-peak absorption bandwidth at least 50% of which lies in a spectral region unoccupied by the half-peak absorption bandwidth of the other dye. More preferably, the dyes have half-peak absorption bandwidths which are offset by 75%. And optimally, the dyes have half-peak absorption wavelengths which are offset by 100%.

In a preferred embodiment, the photographic element's emulsion layer contains a stoichiometric excess of silver. By "stoichiometric excess of silver", it is meant that the layer contains a stoichiometric excess of silver developed by the second developing solution relative to the amount of Compound X remaining after development by the first developing solution. Where Compound X is a ballasted coupler, stoichiometric excess of silver means that the emulsion layer is coupler starved. That is, upon reduction of the silver ions of the non-latent image containing grains to silver metal, and the concurrent conversion of the second developing solution's developing agent to oxidized developing agent, all of the coupler in the region of the non-latent image is converted to the second dye by reaction with the oxidized developing agent, and any additional oxidized developing agent formed as a result of higher levels of silver developed by the second developing solution does not produce any additional second dye. Coupler starvation is specifically described in U.S. Pat. No. 5,314,794, which is incorporated herein by reference.

Where Compound X is a ballasted developing agent, a stoichiometric excess of silver means that in the region of the non-latent image, all of the ballasted developing agent remaining after development by the first developing solution will be oxidized in the conversion of silver ion to silver metal by the second developing solution; and that upon exhaustion of the ballasted developing agent in such region, there will still exist some undeveloped non-latent image containing silver halide grains.

B. Preferred Embodiments

As described, the preferred embodiment of the present invention provides a method of producing a dye image by processing an imagewise exposed color photographic element containing at least one silver halide emulsion layer, the emulsion layer: (1) containing a stoichiometric excess of silver; (2) being comprised of both latent image and non-latent image containing silver halide grains; and (3) having a distribution of Compound X, Compound X being either a ballasted coupler capable of reacting with an oxidized developing agent of a developing solution, or a ballasted developing agent capable, in an oxidized state, of reacting with a component of a developing solution, said method comprising:

A. contacting the photographic element with a first developing solution to develop the latent image containing grains and to imagewise convert the distribution of Compound X to a first dye;

B. rendering the non-latent image containing grains developable; and

C. contacting the photographic element with a second developing solution to develop the non-latent image containing grains, and to convert residual Compound X to a second dye;

wherein the first dye has a spectral characteristic which is non-coextensive with that of the second dye.

Preferably Compound X is a ballasted coupler. As noted, though, it may also be a ballasted developing agent. In such instances, the emulsion layer and/or the first and second developing solutions preferably contain an electron transfer agent (ETA) to assist in the redox reaction involving the developing agent and the latent image or developable non-latent image containing silver halide grains. Representative ETA's are as described in *Research Disclosure,* November 1976, Item 15162, page 79 (referenced as developing agents), which is incorporated herein by reference.

To fully embrace the advantages of the invention, it is important to distinguish between the two forms of Compound X and to track their activity in the inventive process. In the preferred embodiment, where Compound X is a ballasted coupler, contact of the element with a developing agent contained in the first developing solution results in a reduction of latent image silver to silver metal and a concurrent formation of oxidized developing agent. This oxidized developing agent then couples with the ballasted coupler to form a first dye. What is left in the original coupler laydown (i.e., the coupler distribution) is an imprint of the latent image. This imprint is central to the ability of the present method's ability to improve imaging efficiency and image quality.

The non-latent image containing silver halide grains which were not converted to silver metal in the first development step are then uniformly rendered developable. Standard techniques known in the art, for example, uniform fogging with a light source or chemical fogging, can be utilized to accomplish this.

A second development step is employed which utilizes a second developing solution typically containing a developing agent different than the one utilized in the first developing solution. This developing agent reduces the non-latent image containing grains to silver metal as it is oxidized. The oxidized developing agent in the region of the reduced non-latent image containing silver halide grains then couples with the residual coupler to form the second dye.

Where Compound X is a coupler, it can be any ballasted coupler capable of being converted to a first dye in the first developing solution, while capable of being converted to a second dye in the second developing solution. As stated, each dye should be spectrally distinguishable from the other. That is, the first dye should have a spectral characteristic which is non-coextensive with that of the second dye.

Where Compound X is a ballasted coupler, the first developing solution will contain a first developing agent and the second developing solution will contain a second, different developing agent. The developing agents can be any developing agents that will allow the requisite conversions of Compound X to occur. In other words, the criticality of the selection of coupler can not be defined independently of the selection of the developing agent (and hence, developing solution), and vice versa. Many different couplers are capable of being utilized in the present invention as long as they are made immobile by virtue of their ballast, and are utilized with the appropriate developing agents.

Couplers suitable for the invention can be defined as being N-equivalent depending on the number of atoms of silver ion required to form one molecule of dye. An N-equivalent coupler requires the reduction of N moles of silver ion to silver metal with a corresponding formation of oxidized developer.

Typical couplers useful in the practice of the invention are either 4-equivalent or 2-equivalent, although couplers having an equivalency anywhere from 2 to 8 are specifically contemplated. A 4-equivalent coupler can generally be converted into a 2-equivalent coupler by replacing a hydrogen at the coupling site with a different coupling-off group. Coupling-off groups are well known in the art. Such groups can also modify the reactivity of the coupler. They can also advantageously affect the layer in which the coupler is coated, or other layers in the photographic element, by performing, after release from the coupler, functions such as dye formation, dye hue adjustment, development acceleration or inhibition, bleach acceleration or inhibition, electron transfer facilitation, color correction and the like.

Representative classes of coupling-off groups include chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Ballasted couplers which react with oxidized color developing agents and which are suitable for use in the invention are described in the following representative patents and publications, all of which are incorporated herein by reference: "Farbkuppler—Eine Literature Ubersicht," published in Agfa Mitteilungen, Band III, pp. 112–175 (1961), and U.S. Pat. Nos. 2,367,531; 2,423,730; 2,474,293; 2,772,162; 2,895,826; 3,002,836; 3,034,892; 3,041,236; 4,883,746; 2,600,788; 2,369,489; 2,343,703; 2,311,082; 2,908,573; 3,062,653; 3,152,896; 2,875,057; 2,407,210; 3,265,506; 2,298,443; 3,048,194; 3,447,928 and 3,519,429. Preferred couplers are described in, for instance, U.S. Pat. Nos. 5,238,803 and 5,360,713; European Patent Applications 0 544,322; 0 556,700; 0 556,777; 0 565,096; 0 570,006; and 0 574,948. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patents 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; and U.S. Pat. Nos. 4,659,652; 5,066,575; and 5,250,400.

Exemplary structures for couplers capable of forming magenta dye upon coupling with oxidized developing agent are as follows:

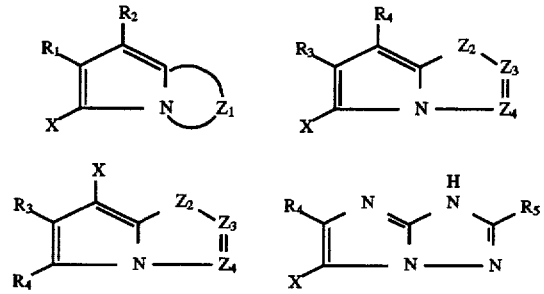

wherein $R_1$, $R_5$ and $R_8$ (defined below) each represent hydrogen or a substituent; $R_2$ represents a substituent; $R_3$, $R_4$ and $R_7$ (defined below) each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group, the dissociative group having an acidic proton that preferably has a pKa value of from 3 to 12 in water; $Z_2$ represents —C($R_7$)= or —N=; and $Z_3$ and $Z_4$ each represent —C($R_8$)= or —N=. Substituents as defined above and in subsequent structures can be aliphatic, carbocyclic, heterocyclic or other groups.

Hammett's constants in the above structures are defined in accordance with Hammett's rule proposed in 1935 for the purpose of quantitatively discussing the influence of substituents on reactions or equilibria of a benzene derivative having the substituent thereon. The rule has become widely accepted. The values for Hammett's substituent constants can be found or measured as is described in the literature.

For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

Other exemplary structures for magenta dye-forming couplers are as follows:

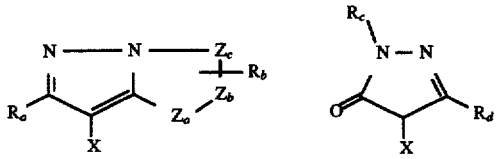

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$–$Z_b$ bond or the $Z_b$–$Z_c$ bond is a double bond and the other is a single bond, and when the $Z_b$–$Z_c$ bond is a carbon-carbon double bond, it may form part of an aromatic ring, and at least one of $Z_a$, $Z_b$, and $Z_c$ represents a methine group connected to the group $R_b$.

Exemplary structures for couplers capable of forming cyan dye upon coupling with oxidized developing agents are as follows:

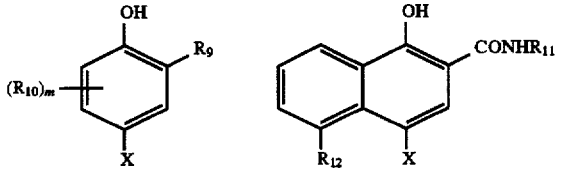

wherein $R_9$ represents a substituent (preferably a carbamoyl, ureido, or carbonamido group); $R_{10}$ represents a substituent (preferably selected from a halogen, alkyl, or carbonamido group); $R_{11}$ represents ballast substituent; $R_{12}$ represents hydrogen or a substituent (preferably a carbonamido or sulphonamido group); X represents hydrogen or a coupling-off group; and m is from 1–3.

Exemplary structures for couplers capable of forming yellow dye upon coupling with oxidized developing agents are as follows:

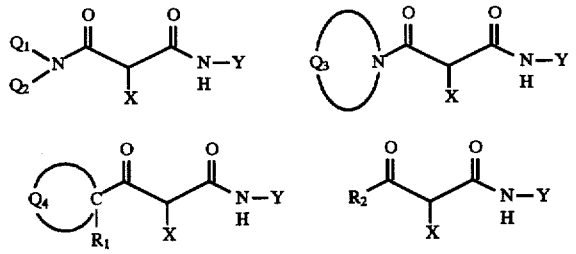

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the —N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Specific representative couplers that may be used with the photographic elements are shown below.

C-1

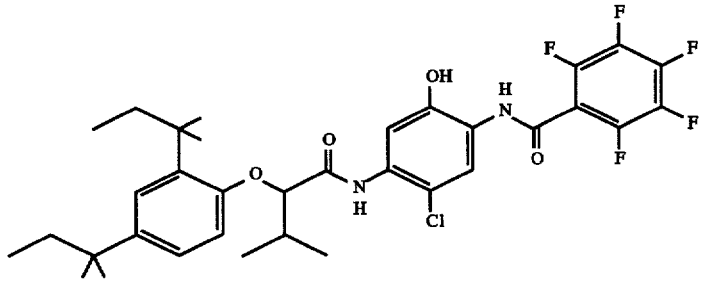

C-2

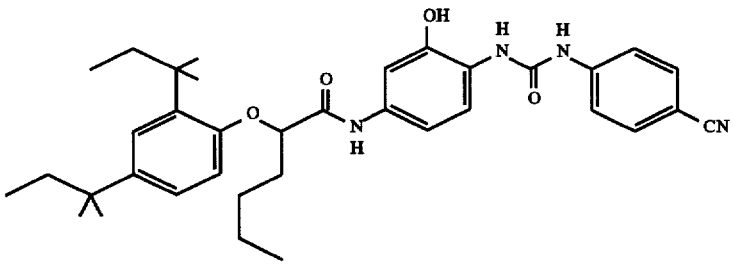

-continued
C-3
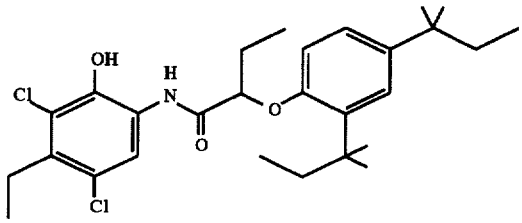
C-4
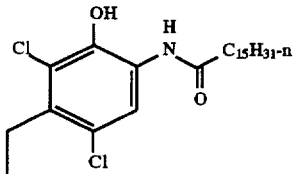
C-5
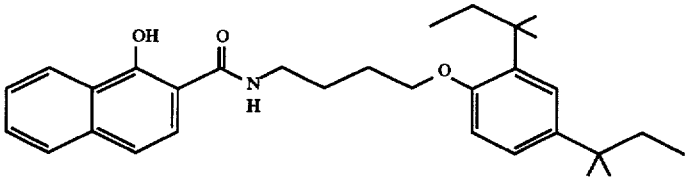
C-6
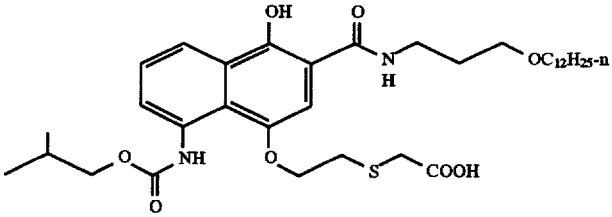
C-7
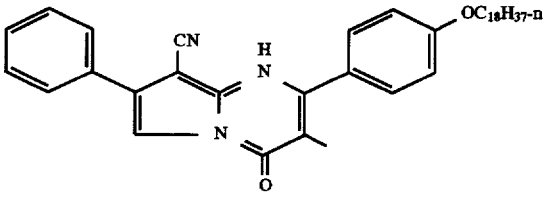
C-8
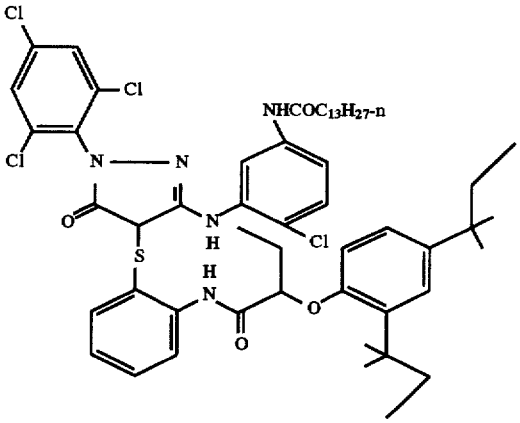

-continued
C-9
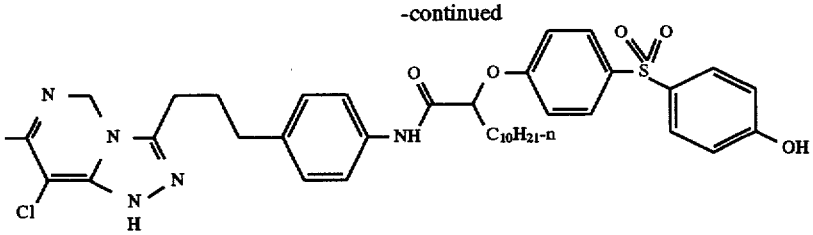
C-10
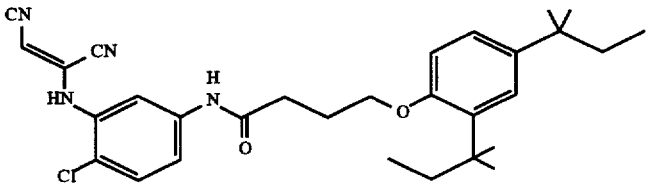
C-11
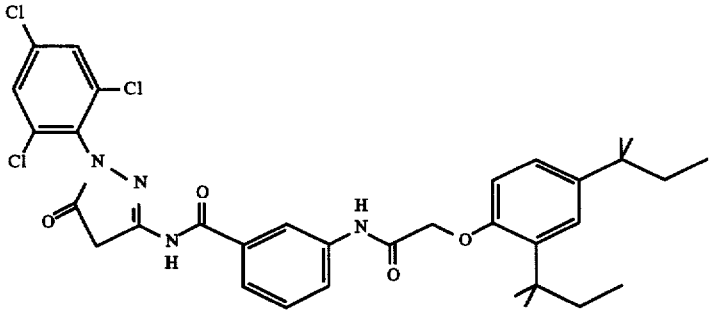
C-12
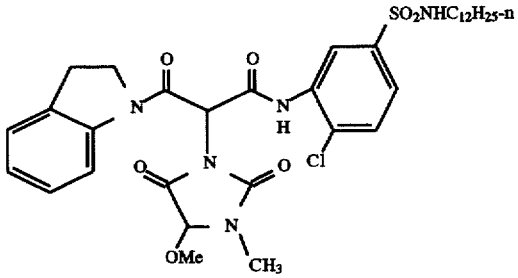
C-13
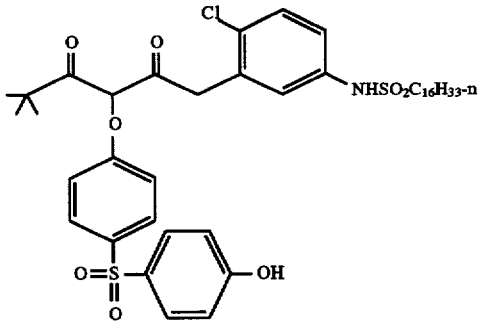
C-14
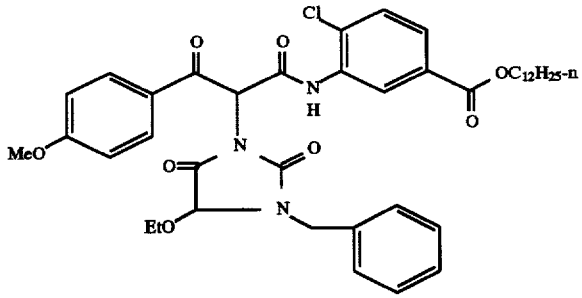

Many different developing agents are capable of being utilized in the practice of the invention as long as the oxidized form of the developing agent produced by reduction of latent silver halide grains allows the requisite conversions of Compound X to occur. Preferred types of developing agents which may be used for the practice of this invention include any of well-known aromatic primary amine developing agents. Preferred developing agents are aminophenol and p-phenylenediamine derivatives characterized by the following structures:

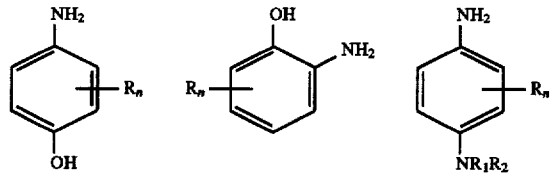

wherein the phenyl ring may be singly or multiply substituted by R. R, $R_1$, and $R_2$ may be chosen from hydrogen, halogen, alkoxy, alkyl, sulfonyl, N,N-disubstituted-aminoalkyl, and N,N-disubstituted-carbonamido (wherein the amino group of the latter two substituent groups may be substituted with the same or different groups selected from hydrogen and optionally substituted alkyl, aryl, and heterocyclic groups; alternatively the amino nitrogen may be part of a heterocyclic ring). n is an integer of from 0 to 4.

Particularly useful primary aromatic amino developing agents are the p-phenylenediamines and especially the N,N-dialkyl-p-phenylenediamines in which the alkyl groups or the aromatic nucleus can be substituted or unsubstituted.

These p-phenylenediamine derivatives may take salt forms, for example, sulfate, hydrochlorate, sulfite, and p-toluenesulfonate salts. The aromatic primary amine developing agents are generally used in amounts of about 0.1 to 20 grams, preferably about 0.5 to 10 grams per liter of the developer.

Another class of developing agents useful in the practice of the invention are the sulfonhydrazides represented in U.S. Pat. No. 4,481,268, the disclosure of which is incorporated herein by reference.

Representative examples of developing agents useful in the practice of the invention are shown below:

| | |
|---|---|
| D-1 | o-aminophenol, |
| D-2 | N-methyl-p-aminophenol, |
| D-3 | 5-amino-2-hydroxytoluene, |
| D-4 | 2-amino-3-hydroxytoluene, |
| D-5 | 2-hydroxy-3-amino-1,4-dimethylbenzene, |
| D-6 | N,N-diethyl-p-phenylenediamine, |
| D-7 | 2-amino-5-diethylaminotoluene, |
| D-8 | 2-amino-5-(N-ethyl-N-laurylamino)toluene |
| D-9 | 4-[N-ethyl-N-(beta-hydroxyethyl)amino] aniline, |
| D-10 | 2-methyl-4-[N-ethyl-N-(beta-hydroxyethyl)amino]-aniline, |
| D-11 | 4-amino-3-methyl-N-ethyl-N-[beta-(methanesulfonamido)ethyl]aniline, |
| D-12 | N-(2-amino-5-diethylaminophenylethyl) methanesulfonamide, |
| D-13 | N,N-dimethyl-p-phenylenediamine monohydrochloride, |
| D-14 | 4-N,N-diethyl-2-methylphenylenediamine monohydrochloride, |
| D-15 | 4-(N-ethyl-N-2-methanesulfonylaminoethyl)-2-methylphenylenediamine sesquisulfate monohydrate, |
| D-16 | 4-(N-ethyl-N-2-hydroxyethyl)-2-methylphenylenediamine sulfate, |

-continued

| | |
|---|---|
| D-17 | 4-amino-3-methyl-N-ethyl-N-methoxyethylaniline, |
| D-18 | 4-amino-3-methyl-N-ethyl-N-beta-ethoxyethylaniline, |
| D-19 | 4-amino-3-methyl-N-ethyl-N-beta-butoxyethylaniline, |
| D-20 | 4-N,N-diethyl-2,2'-methanesulfonylaminoethylphenylenediamine hydrochloride, and |
| D-21 | 2,6-dichloro-p-aminophenol. |

In addition to the primary developing agent, developing solutions typically contain a variety of other agents such as alkalies to control pH, bromides, iodides, benzyl alcohol, anti-oxidants, anti-foggants, solubilizing agents, brightening agents and so forth. The developer may contain a preservative, for example, sulfites such as sodium sulfite, potassium sulfite, sodium bisulfite, potassium bisulfite, sodium metabisulfite, potassium metabisulfite, and carbonyl sulfite adducts if desired. The preservative is preferably added in an amount of 0.5 to 10 grams, more preferably 1 to 5 grams per liter of the developer.

Other useful compounds which can directly preserve the aromatic primary amine developing agents, are for example, hydroxylamines, hydroxamic acids, hydrazines and hydrazides, phenols, hydroxyketones and aminoketones.

Photographic developing solutions are employed in the form of aqueous alkaline working solutions having a pH of above 7, and most typically in the range of from about 9 to 13. The developing solutions may further contain any of known developer ingredients.

To maintain the pH within the above-defined range, various pH buffering agents are preferably used. Several non-limiting examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicate), as well as other alkali metal carbonates or phosphates.

Various chelating agents may be added to the developing solution as an agent for preventing precipitation of calcium and magnesium or for improving the stability of the developer. Preferred chelating agents are organic acids, for example, aminopolycarboxylic acids, organic phosphonic acids, and phosphonocarboxylic acids. Examples of these acids include:

nitrilotriacetic acid,
diethylenetriaminepentaacetic acid,
ethylenediaminetetraacetic acid,
N,N,N-trimethylene phosphonic acid,
ethylenediamine-N,N,N',N'-tetramethylenephosphonic acid,
transcyclohexanediaminetetraacetic acid,
1,2-diaminopropanetetraacetic acid,
hydroxyethyliminodiacetic acid,
glycol ether diamine tetraacetic acid,
ethylenediamine o-hydroxyphenylacetic acid,
2-phosphonobutane-1,2,4-tricarboxylic acid,
1-hydroxyethylidene-1,1-diphosphonic acid, and
N,N'-bis(2-hydroxylbenzyl)ethylenediamine-N,N'-diacetic acid.

The chelating agents may be used alone or in a mixture of two or more. The chelating agent is added to the developing solution in a sufficient amount to block metal ions in the developer, for example, 0.1 to 10 grams per liter of the developing solution.

The developing solution may contain a development promoter if desired. Useful development promoters include thioethers, p-phenylenediamine compounds, quaternary ammonium salts, amines, polyalkylene oxides, 1-phenyl-3-pyrazolidones and imidazoles.

The developing solution may further contain an antifoggant if desired. Useful antifoggants are alkali metal halides such as sodium chloride, potassium bromide, potassium iodide and organic antifoggants. Typical examples of the organic antifoggant include nitrogenous heterocyclic compounds, for example:

benzotriazole,
6-nitrobenzimidazole,
5-nitroisoindazole,
5-methytbenzotriazole,
5-nitrobenzotriazole,
5-chlorobenzotriazole,
2-thiazolylbenzimidazole,
2-thiazolylmethylbenzimidazole,
indazole,
hydrozyazaindolizine, and
adenine.

The developing solution used herein may further contain a brightener which is typically a 4,4'-diamino-2,2'-disulfostilbene compound. It is typically used in an amount of 0 to 5 gram/liter, preferably 0.1 to 4 gram/liter.

If desired, various surface active agents, for example alkyl sulfonic acids, aryl sulfonic acids, aliphatic carboxylic acids, and aromatic carboxylic acids may be added.

The temperature at which photosensitive material is processed with the developer is generally 20° C. to 50° C., preferably 30° C. to 40° C. The processing time generally ranges from 20 seconds to 300 seconds, preferably from 30 seconds to 200 seconds.

Representative combinations of ballasted couplers and developing agents preferred in the practice of the invention, and the nature of their respective products, include the following. It is well within the purview of those skilled in the art to readily determine which other combinations of couplers and developing agents are appropriate for practice of the invention.

| Ballasted Couplers | First Developing Agent | First Dye (Hue) | Second Developing Agent | Second Hue (Hue) |
|---|---|---|---|---|
| C-5 | D-16 | Cyan | D-2 | Magenta |
| C-5 | D-16 | Cyan | D-24 | Magenta |
| C-2 | D-16 | Cyan | D-2 | Magenta |
| C-2 | D-16 | Cyan | D-24 | Magenta |
| C-3 | D-16 | Cyan | D-2 | Magenta |
| C-3 | D-16 | Cyan | D-24 | Magenta |
| C-8 | D-16 | Magenta | D-2 | Yellow |
| C-9 | D-16 | Magenta | D-2 | Yellow |
| C-11 | D-16 | Magenta | D-2 | Yellow |
| C-13 | D-16 | Yellow | D-2 | Cyan |
| C-13 | D-16 | Yellow | D-24 | Cyan |
| C-14 | D-16 | Yellow | D-2 | Cyan |
| C-14 | D-16 | Yellow | D-24 | Cyan |

During the method of the present invention, the element may also be subjected to additional chemical or non-chemical processing steps. These include the scanning and digital processing techniques referenced above in Bird and Kaplan. Scanning typically involves the recordation (point by point, or line by line) of a light beam(s) transmitted or reflected from an image, relying on either developed silver or dyes to modulate the beam. The records produced by the modulation of the beam(s) can then be read into any convenient memory medium (e.g. an optical disk). Systems in which the beam(s) passes through an intermediary, such as a scanner or computer, are often referred to as "hybrid" imaging systems. Relevant scanning and digital processing techniques are also illustrated in U.S. Pat. Nos. 5,314,792; 4,553,165; 4,631,578; 4,654,722; 4,670,793; 4,694,342; 4,805,301; 4,829,370; 4,839,721; 4,841,361; 4,937,662; 4,891,713; 4,912,569; 4,920,501; 4,929,979; 4,962,542; 4,972,256; 4,977,521; 4,979,027; 5,003,494; 5,008,950; 5,065,255; 5,051,842; 5,012,333; 5,070,413; 5,107,346; 5,105,266; 5,105,469; and 5,081,692 all of which are incorporated herein by reference.

After the second developing step, the element may also be contacted with a stop, wash, bleach, fix, or blix bath. In a particularly preferred embodiment, the first developing solution is only a partial grain developer, meaning that it does not fully develop all of the latent image containing grains. A subsequent developing step with a third developing solution (and third developing agent), typically a black and white developing solution which reduces the latent image silver ion to silver but does not form a dye from Compound X, is therefore required before application of the second developing solution so as to completely develop the latent image containing grains. An advantage of this methodology is that higher image quality can be directly obtained in the resulting image.

In the alternative embodiment of the invention, the photographic element contains a distribution of a ballasted developing agent rather than a ballasted coupler. It preferably also contains an electron transfer agent, although it is more preferred that the electron transfer agent be present in the developing solutions rather than in the element. As previously described, the electron transfer agent assists in the redox reaction involving the developing agent and the latent image or developable non-latent image containing silver halide grains.

Conversion of the ballasted developing agent to the first and second dyes occurs after it is oxidized, and upon contact with a component of the first and second developing solutions. The components capable of reacting with the oxidized developing agent to convert it to dyes are typically couplers.

After imagewise conversion of Compound X to the first dye, the element is subjected to a step wherein the non-latent image containing grains are rendered developable. This step can be as described for the preferred embodiment. The element is then contacted with a second developing solution containing a coupler capable of coupling with the oxidized ballasted developing agent to form the second dye.

As with the preferred embodiment, the element can be subjected to additional processing steps such as a third development step, washing, bleaching, fixing, or blixing. The element can be scanned as described, and the information recorded in its image digitized and subsequently processed.

Representative combinations of ballasted developing agents, first and second developing solution components, and the nature of their respective products are set forth in the Table below.

| Ballasted Developing Agent | First Developing Solution Component | First Dye (hue) | Second Developing Solution Component | Second Dye (hue) |
|---|---|---|---|---|
| 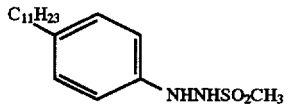 | 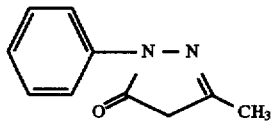 | yellow | 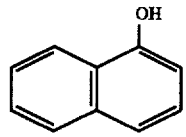 | magenta |
| 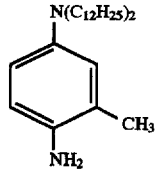 | 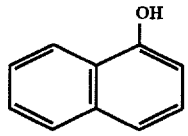 | cyan | 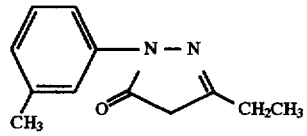 | magenta |

In the practice of the present invention, the silver halide emulsion layer comprising Compound X may be comprised of any halide distribution. Thus, it may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. In accordance with the invention, it is preferred that the emulsion be predominantly silver bromoiodide. By predominantly silver bromoiodide, it is meant that the grains of the emulsion are greater than about 50 mole percent the indicated halide. Preferably, they are greater than about 75 mole percent of the indicated halide; more preferably greater than about 90 mole percent of the indicated halide; and optimally greater than about 95 mole percent of the indicated halide.

The silver halide emulsion employed in the practice of the invention can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

The emulsion can include coarse, medium or fine silver halide grains. The silver halide emulsion can be either monodisperse or polydisperse as precipitated. The grain size distribution of the emulsion can be controlled by silver halide grain separation techniques or by blending silver halide emulsions of differing grain sizes.

The grains can be contained in any conventional dispersing medium capable of being used in photographic emulsions. Specifically, it is contemplated that the dispersing medium be an aqueous gelatin-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing media comprised of synthetic colloids.

The photographic element may be a simple single emulsion layer element or a multilayer, multicolor element. A multicolor element contains dye image-forming units sensitive to each of the three primary regions of the visible light spectrum. Each unit can be comprised of a single emulsion layer, or of multiple emulsion layers sensitive to a given region of the spectrum. The layers of the element, including the layers of the image-forming units, can be arranged in various orders as known in the art. Any one or any combination of emulsion layers or image forming units may contain Compound X, where Compound X can be a different compound for each layer or unit. It is preferred that all image forming units contain a distribution of Compound X.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. In the preferred embodiment, each of the color forming light sensitive layers contains a different form of Compound X.

The photographic element may also contain a transparent magnetic recording layer such as a layer containing magnetic particles on the underside of a transparent support, as in U.S. Pat. Nos. 4,279,945 and 4,302,523 and *Research Disclosure,* November 1993, Item 3490, which are incorporated herein by reference. Typically, the element will have a total thickness (excluding the support) of from about 5 to about 30 microns.

In the following Table, reference will be made to (1) *Research Disclosure,* December 1978, Item 17643, (2) *Research Disclosure,* December 1989, Item 308119, (3) *Research Disclosure,* September 1994, Item 36544, all published by Kenneth Mason Publications, Ltd., Dudley Annex, 12a North Street, Emsworth, Hampshire PO10 7DQ, ENGLAND, the disclosures of which are incorporated hereinby reference. The Table and the references cited in the Table are to be read as describing particular components suitable for use in the photographic element processed according to the invention. The Table and its cited references also describe suitable ways of exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation; Emulsion preparation including hardeners, coating |
| 3 | I, II, III, IX A & B | aids, addenda, etc. |
| 1 | III, IV | Chemical sensitization and |

-continued

| Reference | Section | Subject Matter |
|---|---|---|
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Specifically, dopants, such as compounds of copper, thallium, lead, bismuth, cadmium and Group VIII noble metals, can be present during the process of preparing the elements utilized in the present invention or during the preparation of silver halide grains employed in the emulsion layers of the photographic element. Other dopants include transition metal complexes as described in U.S. Pat. Nos. 4,981,781, 4,937,180, and 4,933,272.

The silver halide grains of the photographic element can further be surface-sensitized, and noble metal (e.g., gold), middle chalcogen (e.g., sulfur, selenium, or tellurium) and reduction sensitizers, employed individually or in combination, are specifically contemplated.

The silver halide grains can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyanines.

The photographic elements can contain image and image-modifying couplers, brighteners, antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), anti-stain agents and image dye stabilizers, light absorbing and scattering materials, hardeners, polyalkyleneoxide and other surfactants as described in U.S. Pat. No. 5,236,817, coating aids, plasticizers and lubricants, anti-static agents, matting agents, development modifiers.

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image as described above. Development is typically followed by the conventional steps of bleaching, fixing, or bleach-fixing, to remove silver or silver halide, washing, and drying.

The practice of the invention is described in detail below with reference to specific illustrative examples, but the invention is not to be construed as being limited thereto.

Example 1

In this example, coating densities, set out in brackets ([]), are reported in terms of grams per square meter, except as specifically noted. Silver halide coverages are reported in terms of silver.

A series of negative working photographic elements was prepared by methods known in the art. The elements' emulsion layers were sulfur and gold sensitized, and spectrally sensitized to the green region. A dye-forming coupler was dispersed in gelatin solution in the presence of approximately equal amounts of coupler solvents (tricesyl phosphate, dibutyl phthalate, or diethyl lauramide). The photographic elements had the following structure.

Layer 1: Gelatin Undercoat

Gelatin [4.9].

Layer 2: Green Sensitive Recording Layer

Gelatin [4.3];

Green-sensitized silver bromide tabular grain emulsion (mean grain projected area 2.5 $\mu m^2$, mean grain thickness 0.13 μm) [1.08]

Dye forming coupler C-5 [at levels described in Table II].

Layer 3: Overcoat

Gelatin [1.6]

Bis (vinylsulfonyl) methane [0.19].

In addition to the components specified above, 4-hydroxy-6-methyl-1,3,3A,7-tetraazindene, sodium salt was included in each emulsion layer at a level of 1.75 grams per mole of silver halide. Surfactants were included in all layers to facilitate coating.

Samples of the element described above were exposed in a sensitometer using a daylight balanced light source (5500K) and passed through a Wratten™ (Eastman Kodak Company) #9 yellow filter and a graduated neutral density step wedge. The exposed elements were processed according to processing scheme III represented below in Table I.

TABLE I

Processing Schemes

| | Time (min.) | | |
|---|---|---|---|
| | I | II | III |
| Flexicolor C41 ™ color developing solution #1* | 2.5 | — | 2.5 |
| 1% acetic acid stop bath | 1 | — | 1 |

TABLE I-continued

| Processing Schemes | Time (min.) | | |
|---|---|---|---|
| | I | II | III |
| wash ($H_2O$) | 3 | — | 3 |
| Black and White developing solution#1 | — | 8 | 3 |
| wash ($H_2O$) | — | 3 | 3 |
| light fog | — | 1 | 1 |
| Color developing solution #2 | — | 10 | 10 |
| Flexicolor C41 ™ bleach* | 3 | 3 | 3 |
| wash ($H_2O$) | 1 | 1 | 1 |
| Flexicolor C41 ™ fixer* | 3 | 3 | 3 |
| wash ($H_2O$) | 1 | 1 | 1 |

*Flexicolor is a trademark of Eastman Kodak Company.

Black and White Developing Solution #1

| | |
|---|---|
| D-2 developing agent | 0.5 g/L |
| sodium carbonate | 12.0 g/L |
| potassium bromide | 1.0 g/L |
| hydroquinone | 2.0 g/L |
| sodium sulfate | 22.0 g/L |
| $H_2O$ | to make 1 L |

Color Developing Solution 2

| | |
|---|---|
| D-21 developing agent | 3.3 g/L |
| methylenephosphoric acid pentasodium salt | 2.7 g/L |
| phosphonic acid | 13.0 g/L |
| sodium bromide | 0.6 g/L |
| potassium iodide | 0.037 g/L |
| potassium hydroxide | 28.0 g/L |
| sodium sulfite | 6.0 g/L |

Table II below sets forth the data for this Example and demonstrates the advantages provided with respect to image quality and imaging efficiency when the elements processed in accordance with the invention contain a stoichiometric excess of silver. Elements 1, 2, 3 and 4 were prepared as described above and were identical except for the level of ballasted coupler incorporated into the emulsion layer. Element 1 did not contain a stoichiometric excess of silver whereas Elements 2, 3 and 4 contained varying levels of coupler starvation.

Image quality was evaluated in terms of signal-to-noise ratio, defined as $(0.4343\gamma)/\sigma$ (A comprehensive discussion of this measurement and its relationship to image quality and imaging efficiency can be found in Dainty and Shaw, *Image Science*, Academic Press (1974) pp. 152–189. An increase in the signal-to-noise ratio of the recorded image corresponded to an increase in image quality and ultimately imaging efficiency.

TABLE II

| Relative Log | Signal to Noise Ratio | | | |
|---|---|---|---|---|
| Exposure | Element 1[a] | Element 2[b] | Element 3[c] | Element 4[d] |
| 0.2 | 7.07 | 7.07 | 9.72 | 14.75 |
| 0.4 | 8.19 | 15.12 | 24.09 | 33.13 |
| 0.6 | 29.30 | 37.45 | 52.78 | 62.66 |
| 0.8 | 46.69 | 67.44 | 74.39 | 88.31 |
| 1.0 | 58.22 | 78.12 | 97.41 | 104.80 |
| 1.2 | 69.11 | 69.11 | 88.31 | 105.00 |

TABLE II-continued

| Relative Log | Signal to Noise Ratio | | | |
|---|---|---|---|---|
| Exposure | Element 1[a] | Element 2[b] | Element 3[c] | Element 4[d] |
| 1.4 | 50.25 | 56.80 | 56.80 | 70.83 |
| 1.6 | 34.80 | 33.95 | 33.95 | 33.00 |

[a]coupler coated at 454 mmole/mole Ag
[b]coupler coated at 227 mmole/mole Ag
[c]coupler coated at 114 mmole/mole Ag
[d]coupler coated at 68 mmole/mole Ag As can be seen from the data in Table II, improvements in the image quality and imaging efficiency of photographic elements subjected to the inventive development process can be obtained when such elements are constructed to contain a stoichiometric excess of silver. These improvements are most pronounced in the regions of low and mid exposure (0.2<Relative Log Exposure<1.2). Furthermore, as Table II demonstrates, the greater the stoichiometric excess of silver, the more pronounced the improvements in image quality and imaging efficiency become.

Example 2

In this example, the image quality and imaging efficiency of a photographic element processed according to the invention's method was compared to the image quality and imaging efficiency of identical elements subjected to either a conventional color reversal(II) or color negative(I) processing scheme. The color reversal and color negative processing schemes utilized in this example are set forth above in Table I. The elements utilized were prepared identically to those in Example 1 except that the emulsion layers contained silver bromoiodide tabular grains (4.0% I, mean grain projected area 1.5 $\mu m^2$, mean grain thickness 0.13 μm) instead of silver bromide tabular grains. Further, the emulsion layers contained a level of coupler equal to 114 mmoles/mole silver, thus making such emulsion layers coupler starved (i.e. containing a stoichiometric excess of silver).

Table III below sets forth the data for this Example. It demonstrates that practice of the present invention provides improved image quality and imaging efficiency, as measured in terms of signal to noise ratios, relative to both conventional color negative and color reversal processing schemes. These improvements are most pronounced in the regions of high exposures (Relative Log Exposure >1.2).

TABLE III

| Relative Log Exposure | Signal to Noise Ratio | | |
|---|---|---|---|
| | Process I (Comparison) | Process II (Comparison) | Process III (Invention) |
| 0.0 | 9.07 | 2.05 | 6.67 |
| 0.2 | 18.17 | 8.09 | 14.56 |
| 0.4 | 28.40 | 16.98 | 28.02 |
| 0.6 | 32.36 | 32.12 | 35.98 |
| 0.8 | 30.46 | 43.43 | 43.26 |
| 1.0 | 26.18 | 40.63 | 43.43 |
| 1.2 | 22.71 | 38.30 | 36.84 |
| 1.4 | 20.73 | 31.20 | 36.34 |
| 1.6 | 16.74 | 19.04 | 30.67 |
| 1.8 | 16.01 | 13.04 | 26.01 |
| 2.0 | 11.32 | 10.86 | 17.95 |
| 2.2 | 9.52 | 8.68 | 14.81 |
| 2.4 | 8.73 | 5.60 | 13.42 |

The invention has been described in detail with particular reference to certain preferred embodiments thereof, but it will be understood that variations and modifications can be effected within the spirit and scope of the invention.

What is claimed is:

1. A method of producing a dye image having improved signal-to-noise by processing an imagewise exposed color photographic element containing at least one silver halide emulsion layer, the emulsion layer comprised of both latent image and non-latent image containing grains, and having a distribution of Compound X, Compound X being either a ballasted coupler capable of reacting with an oxidized developing agent of a developing solution, or a ballasted developing agent capable, in an oxidized state, of reacting with a component of a developing solution, where the concentration of silver halide is in stoichiometric excess relative to the concentration of Compound X, said method comprising:

A. contacting the photographic element with a first developing solution to develop the latent image containing grains and to imagewise convert the distribution of Compound X to a first dye;

B. rendering the non-latent image containing grains developable; and

C. contacting the photographic element with a second developing solution to develop the non-latent image containing grains, and to convert residual Compound X to a second dye;

wherein the first dye has a spectral characteristic which is non-coextensive with that of the second dye.

2. A method according to claim 1 wherein Compound X is a ballasted coupler.

3. A method according to claim 2 wherein the emulsion layer is negative-working.

4. A method according to claim 3 wherein the non-latent image forming grains are rendered developable by fogging with a light source, or by chemical fogging.

5. A method according to claim 4 wherein subsequent to contacting the photographic element with the first developing solution, and prior to rendering the non-latent image containing grains developable, the element is contacted with a stop bath and then washed.

6. A method according to claim 5 wherein subsequent to contacting the photographic element with a stop bath, but prior to rendering the non-latent image containing grains developable, the photographic element is contacted with a black and white developer which completes development of the partially developed latent image containing grains without developing the non-latent image containing grains.

7. A method according to claim 3 wherein subsequent to contacting the photographic element with the second developing solution, the element is washed and contacted with one or more bleach, fix, or blix solutions.

8. A method according to claim 1 further comprising the step of scanning and digitally processing the photographic element's reversal dye image.

9. A method according to claim 1 wherein the conversion of Compound X to the first dye upon contact of the photographic element with the first developing solution, and the second dye upon contact of the element with the second developing solution, occurs in the presence of an electron transfer agent.

10. A method according to claim 9 wherein Compound X is a ballasted developing agent.

11. A method according to claim 10 wherein the emulsion layer is negative-working.

12. A method according to claim 11 wherein the non-latent image forming grains are rendered developable by fogging with a light source, or by chemical fogging.

13. A method according to claim 12 wherein subsequent to contacting the photographic element with the first developing solution, and prior to rendering the non-latent image containing grains developable, the element is contacted with a stop bath and then washed.

14. A method according to claim 13 wherein subsequent to contacting the photographic element with a stop bath, but prior to rendering the non-latent image containing grains developable, the photographic element is contacted with a black and white developer which completes development of the partially developed latent image containing grains without developing the non-latent image containing grains.

15. A method according to claim 14 wherein subsequent to contacting the photographic element with the second developing solution, the element is washed and contacted with one or more bleach, fix, or blix solutions.

16. A method according to claim 15 further comprising the step of scanning and digitally processing the photographic element's reversal dye image.

* * * * *